United States Patent [19]

Brown

[11] Patent Number: 4,866,894

[45] Date of Patent: Sep. 19, 1989

[54] STAIRWAY CONSTRUCTION DEVICE

[76] Inventor: Silas Brown, Rt. 2, Box 86, Marine on St. Croix, Minn. 55047

[21] Appl. No.: 120,068

[22] Filed: Nov. 13, 1987

[51] Int. Cl.[4] ..... E04F 21/26

[52] U.S. Cl. ..... 52/182; 52/191

[58] Field of Search ..... 52/182–191, 52/282; 182/189, 220, 228; 248/235, 247–250

[56] References Cited

U.S. PATENT DOCUMENTS

| | | | |
|---|---|---|---|
| 569,464 | 10/1896 | Moore | 52/191 X |
| 960,412 | 6/1910 | Sandblom | 52/182 |
| 973,109 | 10/1910 | Griner | 52/191 |
| 1,063,216 | 6/1913 | Rendle et al. | 52/191 X |
| 2,297,101 | 9/1942 | Greenwall et al. | 52/182 |
| 2,606,345 | 8/1952 | Rhodes | 52/182 |

*Primary Examiner*—Richard E. Chilcot, Jr.

*Attorney, Agent, or Firm*—James R. Haller; Gregory P. Kaihoi; Mary P. Bauman

[57] ABSTRACT

A bracket for use in constructing a stairway of the type having stringers and a plurality of treads and risers. The bracket includes adjacent horizontal and vertical portions attachable to tread and riser members respectively, and an upwardly angled portion carried by an end of the bracket for attached to a stringer. The vertical portion of the bracket includes a downwardly directed finger which is grippingly receivable in an upwardly open slot means of an adjacent bracket, enabling a plurality of identical brackets to be firmly joined together and attached to a plurality of stringers to construct a stairway.

8 Claims, 4 Drawing Sheets

STAIRWAY CONSTRUCTION DEVICE

FIELD OF THE INVENTION

The invention relates to building construction, and more specifically to a bracket for use in constructing a stairway.

BACKGROUND OF THE INVENTION

In the building construction industry, stairways are generally built by manually notching a set of stringers. Typically, triangular notches are removed from a longitudinal edge of each stringer to create mounting surfaces for tread and riser portions of the stairway. The stringers are mounted angled upwardly with respect to the floor, rising from one floor to the next adjacent floor in a building. When the stringers are anchored, tread and riser portions are attached to the notched portions to form the stairsteps of a stairway. This type of stairway is very time consuming to build and the notches weaken the stringer significantly, requiring relatively large dimension lumber to be used.

It is desirable, therefore, to have a device for stairway construction which would eliminate the time consuming notching of stringers while providing a stairway that is strong and rigid with ordinary dimension lumber.

DISCLOSURE OF THE INVENTION

The invention relates to a bracket for use in constructing a stairway of the type having stringers and a plurality of treads and risers. The brackets include adjacent horizontal and vertical portions attachable to tread and riser members, respectively, and attachment means adjacent to and angled upwardly from said horizontal portion for attaching the bracket to a stringer. An upwardly open slot means adjacent an end of a horizontal portion is aligned to grippingly receive a downwardly directed finger of an adjacent bracket.

DETAILED DESCRIPTION OF THE PREFERRED EMBODIMENT

Figure 1:
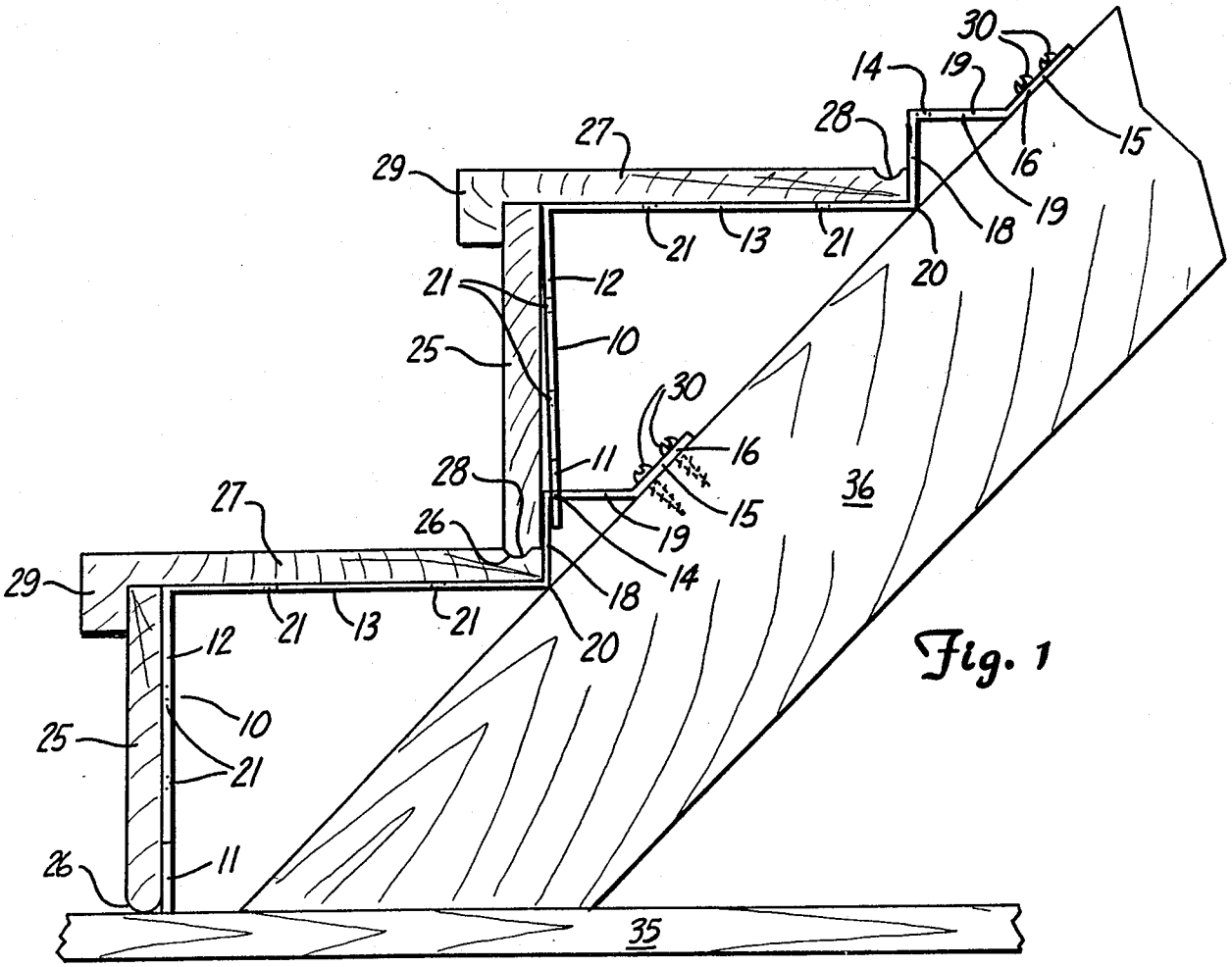
FIG. 1 is a side view of a stairway constructed with brackets of the invention.

As shown in FIG. 1, the stairway construction bracket (10) of the invention is preferably generally "L" shaped, including a plurality of horizontal and vertical portions. The primary horizontal (13) and vertical (12) portions of the bracket (10), which are generally perpendicular to one another, contain a plurality of openings (21) to receive an attachment means (such as nails or screws) to mount tread (27) and riser (25) portions, respectively, thereto.

A second generally vertical portion (18) of the bracket (10) is carried generally perpendicular to the adjacent horizontal portion (13), the intersection of which forms a bend (20) that preferably (but not necessarily) contacts the upper surface of a stringer (36) providing structural support to the bracket (10).

Figure 5:
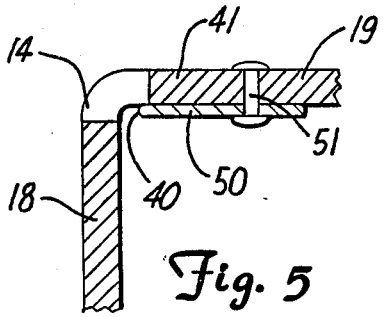
FIG. 5 is a broken-away cross-sectional view similar to FIG. 3 showing an alternate embodiment of the invention.

A second horizontal portion (19) of the bracket (10) is carried adjacent and generally perpendicular to the second vertical portion (18), the second horizontal portion (19) including slot means (14) for receiving a finger (11) of an adjacent bracket (10). Retaining means (40) as shown in FIGS. 3, 4 and 5, is associated with the slot means of the bracket (10) for gripping and retaining the finger portion (11) of an adjacent bracket (10), preventing the finger (11) from moving substantially with respect to said slot means (14).

Figure 2:
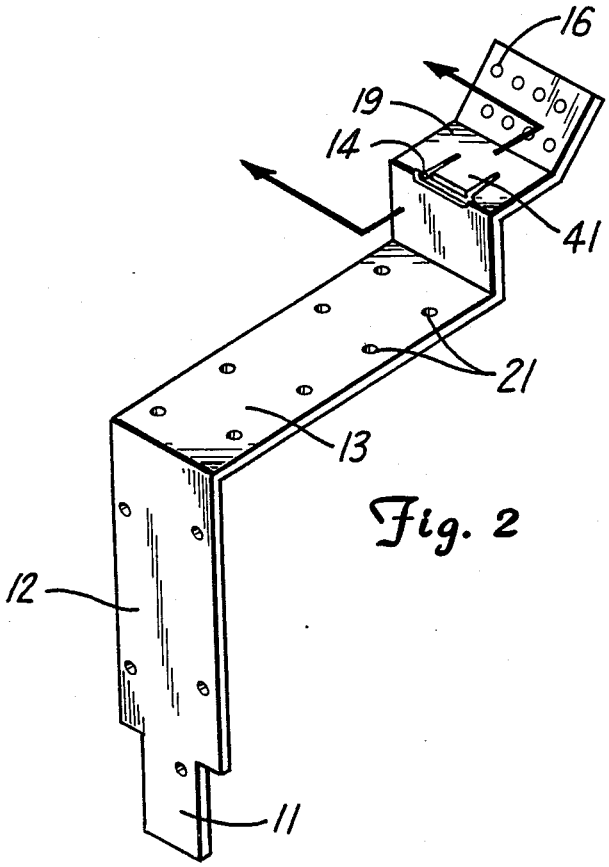
FIG. 2 is a perspective view of a stairway construction bracket of the invention.

Preferably, the slot means (14) and associated retaining means (40), as shown in FIG. 2, are comprised of a generally "U" shaped opening in the second horizontal portion (19) of the bracket (10). The "U" shaped opening forms a resilient tab (41) which functions to grip the finger (11) of an adjacent bracket upon insertion of the finger into the slot (14) to hold it firmly in place, preventing it from withdrawing from the slot means (14). In a preferred embodiment, the bracket (10) includes a shoulder (52), shown in FIGS. 1, 2 and 5, which may contact a portion of an adjacent bracket to limit the distance that the finger (11) is inserted into the slot means (14).

Figure 3:
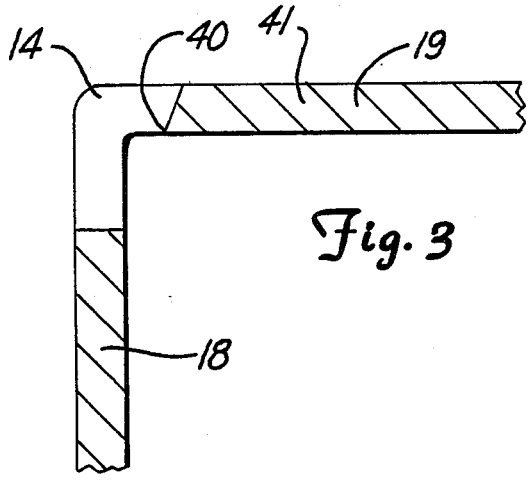
FIG. 3 is a broken-away cross-sectional view of FIG. 2 taken along line 3—3 thereof.
Figure 4:
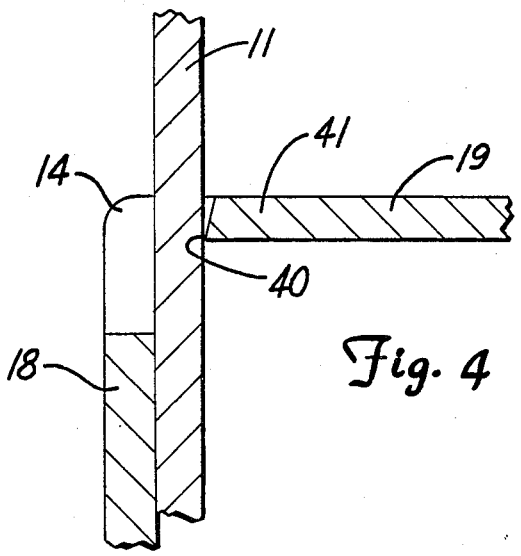
FIG. 4 is a broken-away cross-sectional view similar to FIG. 3 showing a finger of one bracket inserted into a slot of an adjacent bracket.

As shown in the cross sectional view of FIG. 3, the tab (41) preferably has a sharp end (40) which contacts the surface of an inserted finger (11) to hold it firmly in place. FIG. 4 shows a slot (14) with the finger (11) of an adjacent bracket (10) inserted downwardly therethrough FIG. 5 shows another embodiment wherein the retaining means comprises a plate (50) attached beneath the tab (41) by means of a rivet (51) or other suitable attachment means, the plate (50) including a sharp retaining edge (40) to contact and retain a finger (11) inserted into the slot (14).

Attached adjacent to the second horizontal portion (19) and angled upwardly with respect to it, attachment means is carried to facilitate fastening the bracket (10) to a stringer (36).

To build a stairway using the construction (10) of the invention, a plurality of brackets (10), preferably three in number, are aligned parallel to each other attached at spaced intervals to a tread (27) and a riser (25) to form a single stairstep. The stairstep is then positioned in a generally upright position adjacent the bottom of a plurality of stringers (36), preferably three in number, so that the attachment means portion of the brackets (10) can be secured to the stringers (36). An identically constructed stairstep is then positioned above the previously mounted stairstep with the downwardly directed finger portions (11) of its brackets (10) being received in the upwardly open slots (14) of the brackets (10) of the previously mounted stairstep After the fingers (11) are received within the slots (14), the tops of the brackets (10) are attached to the stringers (36) and the building process is repeated until all of the stairsteps are fastened into place.

Utilizing individually prefabricated stairsteps using the bracket of the invention the construction time for a typical one story stairway may be reduced dramatically. Furthermore, the stringers may be of smaller dimensions than traditional stringers since they are not weakened by notches. In a preferred embodiment three 2×6 stringers suffice.

Figure 6:
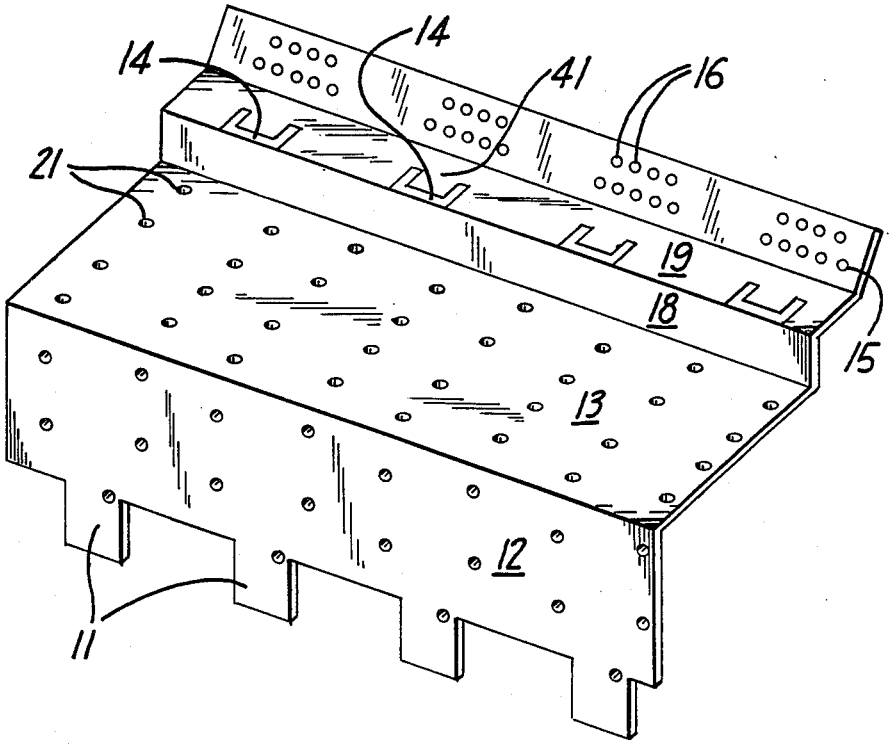
FIG. 6 is a perspective view of another embodiment of the invention.

In another embodiment of the invention, illustrated in FIG. 6, a single bracket extends substantially across the width of a stairway and comprises a plurality of slots (14) extending generally in a widthwise direction to receive a plurality of fingers (11) carried upon an adjacent identical bracket to join the brackets together. These brackets would be substantially the same in cross-section as the brackets described in the preferred embodiment including horizontal (13) and vertical (12) portions attachable to tread and riser members, respectively. This embodiment would eliminate the need for a plurality of brackets to be used on each stairstep assembly.

To add an aesthetically pleasing appearance to the steps, preferably the lower edge (28) of each riser (25) is formed with a generally accurate cross-section as shown in FIG. 1; a complementary trough portion of the tread (27) is formed to receive that edge portion (28). Adhesive may be placed in this trough to secure the construction.

The bracket may be manufactured from any suitable material having the necessary strength and rigidity. Preferably the brackets are stamped out of sheet metal of a suitable thickness.

While a preferred embodiment of the present invention has been described, it should be understood that various changes, adaptations and modifications may be made therein without departing from the spirit of the invention and the scope of the appended claims.

What is claimed is:

1. A bracket for use in constructing a stairway of the type having stringers and a plurality of treads and riser, comprising:

(a) adjacently attached primary horizontal and vertical portions attachable to a tread and riser respectively;

(b) adjacently attached secondary horizontal and vertical portions, the secondary vertical portion being attached to the primary horizontal portion;

(c) attachment means adjacent the secondary horizontal portion and angled generally upwardly with respect to said secondary horizontal portion for attaching the bracket to a stringer;

(d) upwardly open slot means extending through said secondary horizontal portion;

(e) downwardly directed finger means extending from the primary vertical portion, said finger means being grippingly receivable in the slot means of an adjacent bracket.

2. The bracket of claim 1 wherein said attachment means includes a plurality of openings for reception of an anchoring means for attaching the bracket to a stringer.

3. The bracket of claim 1 wherein said upwardly open slot means is shaped to receive a finger means of an adjacent bracket.

4. The bracket of claim 1 wherein said slot means includes retaining means for gripping and retaining the finger means of an adjacent bracket inserted into said slot means.

5. The bracket of claim 1 wherein said finger means includes a shoulder for limiting the distance that the finger may be inserted into the slot means.

6. A stair step for a stairway comprising a tread and a riser, each attached to a plurality of laterally spaced brackets, each bracket comprising (a) adjacently attached primary horizontal and vertical portions attachable to a tread and riser respectively;

(b) adjacently attached secondary horizontal and vertical portions, the secondary vertical portion being attached perpendicularly to the primary horizontal portion;

(c) attachment means adjacent the secondary horizontal portion and angled generally upwardly with respect to said secondary horizontal portion for attaching the bracket to a stringer;

(d) upwardly open slot means extending through said secondary horizontal portion;

(e) downwardly directed fingers means extending from the primary vertical portion, said finger means being grippingly receivable in the slot means of an adjacent bracket.

7. A stairway of the type supported by a plurality of stringers, comprising a plurality of stair steps attached adjacent one another to the stringers, each stair step including tread and riser members attached to a plurality of brackets carried on the stringers generally parallel to and spaced laterally from one another, each bracket comprising:

(a) adjacently attached primary horizontal and vertical portions attachable to a tread and riser respectively;

(b) adjacently attached secondary horizontal and vertical portions, the secondary vertical portion being attached perpendicularly to the primary horizontal portion;

(c) attachment means adjacent the secondary horizontal portion and angled generally upwardly with respect to said secondary horizontal portion for attaching the bracket to the stringer;

(d) upwardly open slot means extending through said secondary horizontal portion;

(e) downwardly directed finger means extending from the primary vertical portion of the bracket, said finger means being grippingly receivable in the slot means of an adjacent bracket;

(f) said attachable means including a plurality of openings carried by the angled portion of the bracket for receiving an anchoring means for attaching the bracket to a stringer; and (g) said slot means being shaped to receive the finger means of an adjacent bracket, and including a retaining means for gripping and retaining the finger means of an adjacent bracket inserted into said slot means.

8. A stairway of the type supported by at least a pair of stringers, comprising a plurality of stair steps attached to the stringers, each stairstep includes a plurality of tread and riser members attached to a plurality of brackets carried on said stringers generally parallel to and spaced laterally from one another, each bracket comprising:

(a) adjacently attached primary horizontal and vertical portions attachable to a tread and riser respectively;

(b) adjacently attached secondary horizontal and vertical portions, the secondary vertical portion being attached perpendicularly to the primary horizontal portion;

(c) attachment means adjacent the secondary horizontal portion and angled generally upwardly with respect to said secondary horizontal portion for attaching the bracket to a stringer;

(d) upwardly open slot means extending through said secondary horizontal portion;

(e) downwardly directed finger means extending from the primary vertical portion, said finger means being grippingly receivable in the slot means of an adjacent bracket.

* * * * *